US008390541B2

(12) United States Patent
Uchino et al.

(10) Patent No.: US 8,390,541 B2
(45) **Date of Patent: *Mar. 5, 2013**

(54) DISPLAY APPARATUS AND DRIVING METHOD THEREFOR, AND ELECTRONIC DEVICE

(75) Inventors: Katsuhide Uchino, Kanagawa (JP); Tetsuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/137,192

(22) Filed: Jul. 27, 2011

(65) Prior Publication Data

US 2011/0285692 A1 Nov. 24, 2011

Related U.S. Application Data

(63) Continuation of application No. 12/073,929, filed on Mar. 12, 2008, now Pat. No. 8,044,894.

(30) Foreign Application Priority Data

Mar. 22, 2007 (JP) ..... 2007-074986

(51) Int. Cl.
*G09G 3/30* (2006.01)

(52) U.S. Cl. ..... 345/76; 345/77; 345/78; 345/79; 345/80; 345/81; 345/82; 345/83; 345/204; 315/169.3

(58) Field of Classification Search ..... 345/92, 345/94, 208, 210, 98, 99, 100, 87, 204, 76–83; 315/169.3; 313/495–497
See application file for complete search history.

(56) References Cited

U.S. PATENT DOCUMENTS

| | | | | |
|---|---|---|---|---|
| 4,750,813 | A * | 6/1988 | Ohwada et al. | 345/87 |
| 7,079,105 | B2 * | 7/2006 | Katagawa | 345/99 |
| 7,164,405 | B1 * | 1/2007 | Jeong et al. | 345/94 |
| 2007/0152920 | A1 * | 7/2007 | Yamashita et al. | 345/76 |

FOREIGN PATENT DOCUMENTS

| | | | |
|---|---|---|---|
| JP | 2003-255856 | A | 9/2003 |
| JP | 2003-271095 | A | 9/2003 |
| JP | 2004-029791 | A | 1/2004 |
| JP | 2004-093682 | A | 3/2004 |
| JP | 2004-133240 | A | 4/2004 |
| JP | 2006-215213 | | 8/2006 |
| JP | 2007-034001 | | 2/2007 |

(Continued)

OTHER PUBLICATIONS

Japanese Office Action issued Mar. 17, 2009 for corresponding Japanese Application No. 2007-074986.

*Primary Examiner* — Lun-Yi Lao
*Assistant Examiner* — Olga Merkoulova
(74) *Attorney, Agent, or Firm* — Rader, Fishman & Grauer PLLC

(57) ABSTRACT

After a sampling transistor is turned ON at a first timing when a control signal has risen, during a sampling period from a second timing when a video signal has risen from a reference potential to a signal potential to a third timing when the control signal has fallen and is turned OFF, the sampling transistor samples and writes the signal potential in a holding capacitance, and negatively feeds back a current flowing into a drive transistor during the sampling period to the holding capacitance and applies mobility correction of the drive transistor on the written signal potential. A signal driver adjusts the second timing for the video signal supplied to respective signal lines to correct a backward shift of the third timing due to a transmission delay along a scanning line of the control signal output from the control scanner.

3 Claims, 18 Drawing Sheets

FOREIGN PATENT DOCUMENTS

| | | |
|---|---|---|
| JP | 2007-034225 | 2/2007 |
| JP | 2007-310311 | 11/2007 |
| JP | 2008-009198 | 1/2008 |
| JP | 2008-040024 | 2/2008 |

* cited by examiner

DISPLAY APPARATUS AND DRIVING METHOD THEREFOR, AND ELECTRONIC DEVICE

CROSS REFERENCES TO RELATED APPLICATIONS

This is a Continuation Application of U.S. patent application Ser. No. 12/073,929, filed Mar. 12, 2008, which claims priority from Japanese Patent Application JP 2007-074986 filed in the Japanese Patent Office on Mar. 22, 2007, the entire contents of which are incorporated herein by reference.

BACKGROUND OF THE INVENTION

1. Field of the Invention

The present invention relates to an active matrix display apparatus using a light emitting element for a pixel and a drive method therefor. The invention also relates to an electronic device provided with such a display apparatus.

2. Description of the Related Art

In recent years, a flat panel light emitting display apparatus using an organic EL device as a light emitting element has been developed. The organic EL device is a device utilizing the phenomenon that light is emitted when an organic thin film is applied with an electric field. The organic EL device is driven at an applied voltage of 10 V or smaller and thus consumes a small amount of electric power. Also, the organic EL device is a light emitting element which emits light from itself. Therefore, the organic EL device does not need an illumination member, and accordingly, it is easy to realize a lighter weight and a thinner structure. Furthermore, the response speed of the organic EL device is about several μs, which is extremely fast, and therefore an after image during video display is not generated.

Among the flat panel light emitting display apparatuses using the organic EL device for the pixel, an active matrix display apparatus in which thin film transistors are formed as drive elements in each pixel in an integrated manner has been particularly developed. Such an active matrix, flat panel light emitting display apparatus is described in, for example, Japanese Unexamined Patent Application Publication Nos. 2003-255856, 2003-271095, 2004-133240, 2004-029791, 2004-093682, and, 2006-215213.

FIG. 23 is a schematic circuit diagram of an example of an active matrix display apparatus in related art. The display apparatus is composed of a pixel array section 1 and a peripheral drive section. The drive section is provided with a horizontal selector 3 and a write scanner 4. The pixel array section 1 is provided with signal lines SL arranged in columns and scanning lines WS arranged in rows. Pixels 2 are arranged at positions where the respective signal lines SL intersect with the scanning lines WS. For facilitating an understanding, in the drawing, only one pixel 2 is illustrated. The write scanner 4 is provided with a shift register. The write scanner 4 is operated in accordance with a clock signal ck supplied from the outside, and sequentially outputs control signals to the scanning lines WS by sequentially transferring a start pulse sp similarly supplied from the outside. The horizontal selector 3 is adapted to supply the signal lines SL with video signals in accordance with the line progressive scanning on the write scanner 4 side.

The pixel 2 is composed of a sampling transistor T1, a drive transistor T2, a holding capacitance C1, and a light emitting element EL. The drive transistor T2 is of a P channel type. A source of the drive transistor T2 is connected to the power source line, and a drain of the drive transistor T2 is connected to the light emitting element EL. A gate of the drive transistor T2 is connected to the signal line SL via the sampling transistor T1. The sampling transistor T1 is put into a continuity state in accordance with the control signal supplied from the write scanner 4, and samples the video signal supplied from the signal line SL to write the video signal in the holding capacitance C1. The drive transistor T2 receives the video signal written in the holding capacitance C1 as a gate voltage Vgs at the gate, and allows a drain current Ids to flow into the light emitting element EL. As a result, the light emitting element EL emits light in accordance with the video signal. The gate voltage Vgs represents a potential at the gate while the source is used as a reference.

The drive transistor T2 is operated in a saturated area, and the relation between the gate voltage Vgs and the drain current Ids is represented by the following characteristic expression;

$$Ids=(1/2)\mu(W/L)Cox(Vgs-Vth)^2$$

where μ represents the mobility of the drive transistor, W represents the channel width of the drive transistor, L represents the channel length of the drive transistor, Cox represents the gate insulation film capacity in unit areas of the drive transistor, and Vth represents the threshold voltage of the drive transistor. As is apparent from this characteristic expression, when the drive transistor T2 is operated in the saturated area, the drive transistor T2 functions as a constant current source for supplying the drain current Ids in accordance with the gate voltage Vgs.

FIG. 24 is a graphic representation of a voltage/current characteristic of the light emitting element EL. The horizontal axis represents an anode voltage V, and the vertical axis represents the drive current Ids. It should be noted that the anode voltage at the light emitting element EL becomes a drain voltage at the drive transistor T2. In the light emitting element EL, as the current/voltage characteristic changes over time, the characteristic curve has a tendency to be flattening together with the elapse of time. For this reason, even when the drive current Ids is constant, the anode voltage (drain voltage) V changes. In that point, with the pixel circuit 2 illustrated in FIG. 23, the drive transistor T2 is operated in the saturated area, and irrespective of the variation of the drain voltage, the drive current Ids can be flown at the gate in accordance with the voltage Vgs can be flown at the gate. Therefore, irrespective of the characteristic change over time of the light emitting element EL, it is possible to maintain the light emission luminance constant.

FIG. 25 is a circuit diagram of another example of the pixel circuit in related art. A difference from the pixel circuit previously illustrated in FIG. 23 is that the drive transistor T2 is of an N channel type instead of the P channel type. For a manufacturing process of the circuit, it is advantageous in many cases to set all the transistors configuring the pixels to the N channel type.

SUMMARY OF THE INVENTION

However, according to the circuit configuration of FIG. 25, because the drive transistor T2 is of the N channel type, the drain of the drive transistor T2 is connected to the power source line, and on the other hand, the source S is connected to the anode of the light emitting element EL. Therefore, in a case where the characteristic of the light emitting element EL changes over time, an influence appears on the potential at the source S and Vgs varies. Thus, the drain current Ids supplied by the drive transistor T2 changes over time. For this reason, the luminance of the light emitting element EL varies over time. Not only the light emitting element EL, but also a threshold voltage Vth and a mobility μ of the drive transistor T2, also are fluctuated for each pixel. These parameters Vth and μ are included in the above-mentioned transistor characteristic expression, and therefore even when Vgs is constant, Ids is changed. As a result, the light emission luminance is changed in each pixel and it is difficult to obtain uniformity of the screen. In the past, a display apparatus provided with a function of correcting the threshold voltage Vth at the drive transistor T2 fluctuating in each pixel (threshold voltage correction function) has been proposed. For example, such a display apparatus is disclosed in the above-mentioned Japanese Unexamined Patent Application Publication No. 2004-133240. Also, a display apparatus provided with a function of correcting the mobility μ of the drive transistor T2 fluctuating in each pixel (the mobility correction function) has been proposed. For example, such a display apparatus is described in the above-mentioned Japanese Unexamined Patent Application Publication No. 2006-215213.

The display apparatus provided with the mobility correction function in related art samples the video signal by turning the sampling transistor T1 ON and carries out the mobility correction in accordance with the write period to the holding capacitance C1 (the sampling period or the writing period). To be more specific, during the sampling period, in accordance with the video signal, a drive current flowing into a drive transistor T1 is negatively fed back to the holding capacitance C1 to apply the correction with respect to the mobility μ of the drive transistor T1 on the video signal written in the holding capacitance C1. Therefore, the sampling period just corresponds to the mobility correction period.

The writing period is regulated by the control signal applied to the gate of the sampling transistor T1. If no distortion occurs in the control signal, the writing period becomes common to all the pixels and the mobility correction time also becomes the same. Therefore, it is assumed that no error of the mobility correction for each pixel is generated. However, in actuality, in the control signal, while the scanning lines WS of the sampling transistor T1 are propagated, due to a load such as a wiring capacitance or a wiring resistance, the waveform is slacked, and a deviation in the mobility correction period appears. Due to this deviation, the effect of the mobility correction is changed, and a difference in the light emission luminance in each pixel is caused. This difference in the light emission luminance appears along the scanning line direction (the lateral direction in the screen), and thus a luminance unevenness, such as shading is generated, which is to be solved.

In view of the above-mentioned related art problems, it is desirable to suppress a variation of a mobility correction period in a display apparatus provided with a mobility correction function to reduce or remove shading. To cope with the above, the following configuration has been conceived, for example. That is, according to an embodiment of the present invention, there is provided a display apparatus including a pixel array section and a drive section for driving the pixel array section, the pixel array section including scanning lines arranged in rows, signal lines arranged in columns, pixels arranged in a matrix, and predetermined power feed lines, the drive section including a control scanner adapted to sequentially output control signals to the respective scanning line and carrying out line progressive scanning on the pixels in units of a row, and a signal driver adapted to supply the signal lines arranged in columns with a signal potential which is a video signal and a reference potential in accordance with the line progressive scanning, the pixels including a light emitting element, a sampling transistor, a drive transistor, and a holding capacitance, the sampling transistor having a gate connected to the scanning line, one of a source and a drain connected to the signal line, and the other of the source and the drain connected to the drive transistor, the drive transistor having one of a source and a drain connected to the light emitting element and the other of the source and the drain connected to the power feed line, the holding capacitance being composed of a display apparatus connected between the source and the gate of the drive transistor, in which after the sampling transistor is turned ON at a first timing when the control signal has risen, during a sampling period from a second timing when the video signal has risen from a reference potential to a signal potential to a third timing when the control signal has fallen and is turned OFF, the sampling transistor samples the signal potential and writes the signal potential in the holding capacitance, the sampling transistor also carries out negative feedback on a current flowing into the drive transistor during the sampling period to the holding capacitance and applies a correction with respect to a mobility of the drive transistor on the signal potential written in the holding capacitance, the drive transistor supplies a drive current to the light emitting element in accordance with the corrected signal potential to emit light, and the signal driver adjusts the second timing for the video signal supplied to the respective signal lines to correct a backward shift of the third timing due to a transmission delay along the scanning line of the control signal output from the control scanner.

Preferably, the gate of the drive transistor is cut off from the signal line when the sampling transistor is turned OFF at the third timing, and when a source potential at the drive transistor is increased due to drive current supply to the light emitting element, a gate potential at the drive transistor is also increased while following the increase in the source potential at the drive transistor to maintain a voltage between the source and the gate constant. Also, preferably, the drive section includes a power source scanner adapted to perform a switching operation for switching a potential at the respective power feed lines arranged in rows between high and low prior to the sampling period, and due to this switching operation, the drive transistor previously writes a threshold voltage at which the cut off occurred in the holding capacitance.

According to the embodiment of the present invention, after the first timing when the control signal has risen, during the sampling period from the second timing when the video signal has risen from the reference potential to the signal potential to the third timing when the control signal has fallen and is turned OFF (between the second timing and the third timing), the sampling transistor samples the signal potential of the video signal to write the signal potential in the holding capacitance. At this time, simultaneously, the current flowing into the drive transistor is negatively fed back to the holding capacitance to carry out the mobility correction. That is, the sampling period corresponds to the mobility correction period. When the control signal propagates the scanning line, slack is generated due to the load, such as the wiring capacitance or the wiring resistance, and the dropping becomes smooth. Thus, the third timing when the sampling transistor is turned OFF is shifted backward. In order to correct the backward shift of the third timing due to this transfer delay, the signal driver adjusts the second timing for the video signal supplied to the respective signal lines. In other words, when the third timing is shifted backward, such that the second timing is shifted backward by the same amount, the signal driver performs a phase adjustment on the video signal supplied to the respective signal lines. Through such a phase adjustment, the mobility correction period from the second timing to the third timing becomes constant along the scanning line and no variation is generated. Therefore, the luminance difference caused by the mobility correction error is suppressed and it is possible to reduce or remove the shading.

DESCRIPTION OF THE PREFERRED EMBODIMENTS

Hereinafter, details of an embodiment of the present invention will be described with reference to the drawings.

Figure 1:
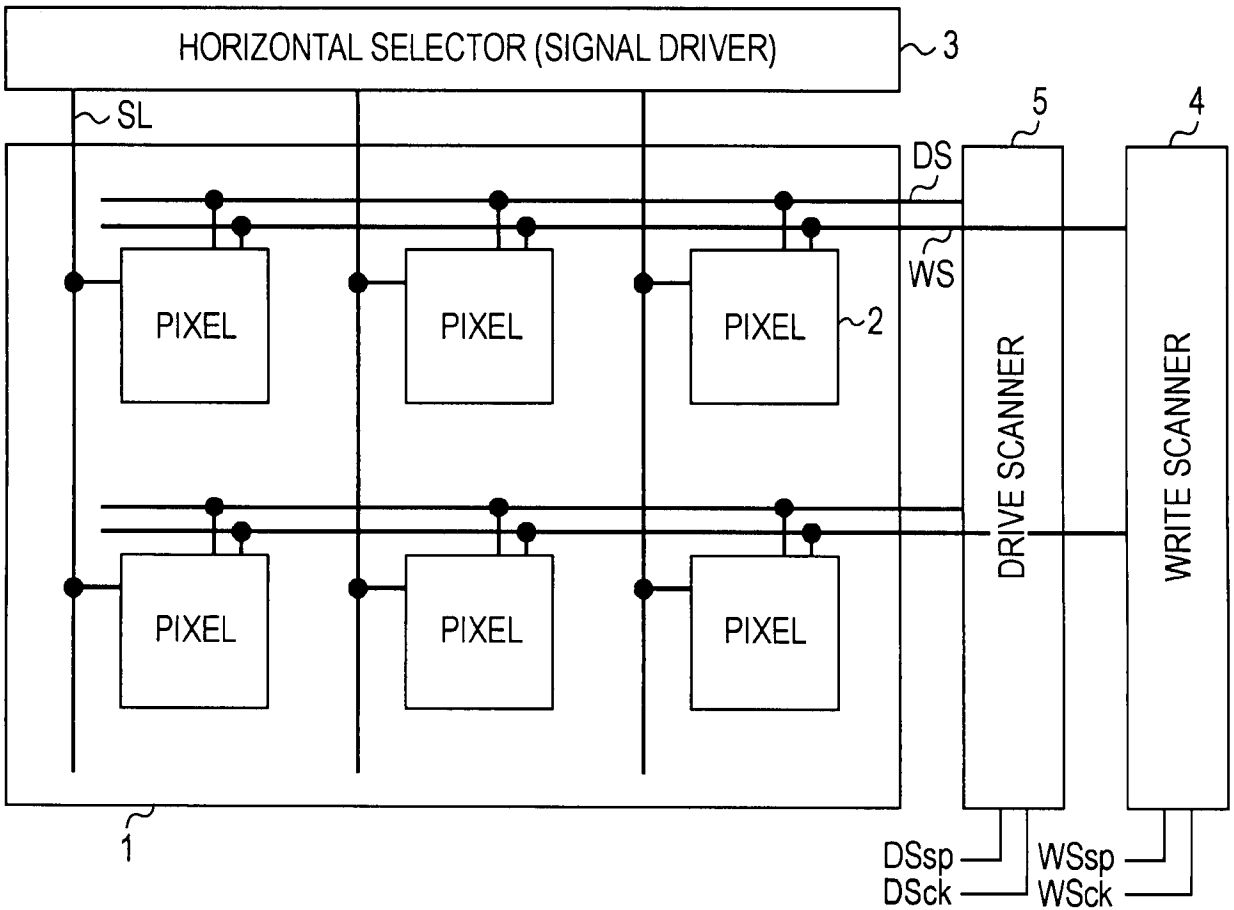
FIG. 1 is a block diagram of an entire configuration of a display apparatus according to an embodiment of the present invention.

FIG. 1 is a block diagram of an entire configuration of a display apparatus according to an embodiment of the present invention. As illustrated in the drawing, the present display apparatus is configured of a pixel array section 1 and drive sections (3, 4, and 5) for driving the pixel array section 1. The pixel array section 1 is provided with scanning lines WS arranged in rows, signal lines SL arranged in columns, pixels 2 arranged in a matrix at positions where the signal lines intersect with the scanning lines, and power feed lines DS arranged corresponding to the respective rows of the respective pixels 2. Drive sections (3, 4, and 5) are provided with a control scanner (write scanner) 4 adapted to sequentially supply the respective scanning lines WS with control signals for carrying out line progressive scanning on the pixels 2 in units of a row, a power supply scanner (drive scanner) 5 adapted to supply, in accordance with the line progressive scanning, the respective power feed lines DS with a power source voltage which switches between a first potential and a second potential, and a signal driver (horizontal selector) 3 adapted to supply, in accordance with the line progressive scanning, the signal lines SL arranged in columns with a signal potential which is a video signal and a reference potential. It should be noted that the write scanner 4 is operated in accordance with a clock signal WSck supplied from the outside and outputs a control signal to the respective scanning lines WS by sequentially transferring a start pulse WSsp similarly supplied from the outside. The drive scanner 5 is operated in accordance with a clock signal DSck supplied from the outside and switches potentials of the power feed lines DS in a line progressive manner by sequentially transferring a start pulse DSsp similarly supplied from the outside.

Figure 2:
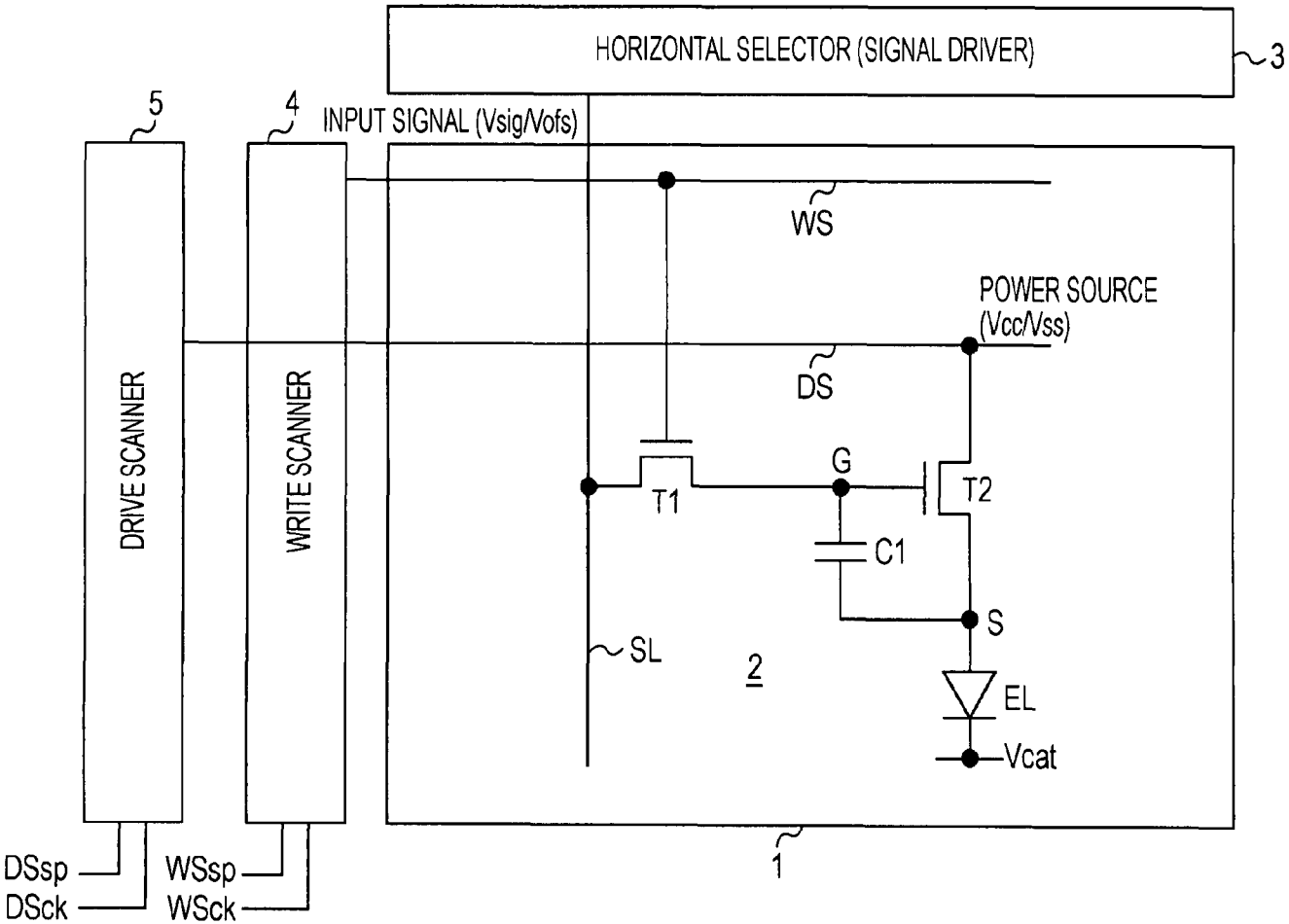
FIG. 2 is a circuit diagram of a pixel example formed on the display apparatus illustrated in FIG. 1.

FIG. 2 is a circuit diagram of a specific configuration of the pixel 2 included in the display apparatus illustrated in FIG. 1. As illustrated in the drawing, the present pixel circuit 2 is configured of a two-terminal type (diode type) light emitting element EL which is represented by an organic EL device or the like, an N-channel type sampling transistor T1, a similar N-channel type drive transistor T2, and a thin-film type holding capacitance C1. A gate of the sampling transistor T1 is connected to the scanning lines WS, one of a source and a drain of the sampling transistor T1 is connected to the signal line SL, and the other is connected to the gate G of the drive transistor T2. One of a source and a drain of the drive transistor T2 is connected to the light emitting element EL and the other is connected to the power feed lines DS. According to the present embodiment, the drive transistor T2 is on the N channel side, the drain side is connected to the power feed lines DS, and the source S side is connected to an anode side of the light emitting element EL. A cathode of the light emitting element EL is fixed to a predetermined cathode potential Vcat. The holding capacitance C1 is connected between the source S and the gate G of the drive transistor T2. To the pixels 2 having such a configuration, the control scanner (write scanner) 4 sequentially outputs the control signals by switching the scanning lines WS between a low potential and a high potential to carry out the line progressive scanning on pixels 2 in units of a row. The power source scanner (drive scanner) 5 supplies, in accordance with the line progressive scanning, the respective power feed lines DS with the power source voltage which switches between a first potential Vcc and a second potential Vss. The signal driver (horizontal selector) 3 supplies, in accordance with the line progressive scanning, the signal lines SL arranged in columns with a signal potential Vsig which is a video signal and a reference potential Vofs.

In such a configuration, after the sampling transistor T1 is turned ON at a first timing when the control signal has risen, during a sampling period from a second timing when the video signal has risen from the reference potential Vofs to the signal potential Vsig to a third timing when the control signal has fallen and is turned OFF (between the second timing and the third timing), the signal potential Vsig is sampled and written in the holding capacitance C1. At this time, simultaneously, a current flowing into the drive transistor T2 is negatively fed back to the holding capacitance C1 to apply a correction with respect to mobility μ of the drive transistor T2 on the signal potential written in the holding capacitance C1. That is, the sampling period from the second timing to the third timing also corresponds to the mobility correction period during which the current flowing into the drive transistor T2 is negatively fed beck to the holding capacitance C1. As a feature according to the embodiment of the present invention, the signal driver (horizontal selector) 3 adjusts the second timing for the video signals supplied to the respective signal lines SL such that a backward shift of the third timing for the control signal output from the control scanner 4 due to the transfer delay along the scanning lines WS is corrected.

In the configuration of FIG. 2, in the control signal output from the write scanner 4, the slack of the waveform or the transfer delay is caused more strongly as the position is moved from the left towards right along the scanning lines WS and the third timing is shifted backward. In accordance with this, when the signal line SL arranged in columns existing from the left side to right side on the screen is supplied with the video signal, the signal driver (horizontal selector) 3 carries out a phase control such that the second timing when the reference potential Vofs is switched to the signal potential Vsig but the delay is relatively more effected as the position is moved towards to the right side. In this manner, as the third timing on the control signal side is shifted backward, the second timing on the video signal side also is shifted backward, and the time between these timings (that is, the mobility correction period) is not varied. Thus, the mobility correction period becomes constant on the right and left sides of the screen, and it is possible to remove the shading.

The pixel circuit illustrated in FIG. 2 also is provided with a threshold voltage correction function in addition with the above-mentioned mobility correction function. That is, before the sampling transistor T1 samples the signal potential Vsig, at the first timing, the power source scanner (drive scanner) 5 switches the power feed lines DS from the first potential Vcc to the second potential Vss. Similarly, before the sampling transistor T1 samples the signal potential Vsig, the control scanner (write scanner) 4 puts the sampling transistor T1 in the continuity state at the second timing to apply the reference potential Vofs on the gate G of the drive transistor T2 from the signal line SL and also sets the source S of the drive transistor T2 to the second potential Vss. The power source scanner (drive scanner) 5 switches the power feed lines DS from the second potential Vss to the first potential Vcc at the third timing after the second timing to hold the voltage of the drive transistor T2 equivalent to the threshold voltage Vth in the holding capacitance C1. Through such a threshold voltage correction function, it is possible for the present display apparatus to cancel an influence of the threshold voltage Vth of the drive transistor T2 fluctuating in each pixel. It should be noted that the orders of the first timing and the second timing are changeable.

The pixel circuit 2 illustrated in FIG. 2 is further provided with a bootstrap function. That is, when the signal potential Vsig is held in the holding capacitance C1, the write scanner 4 puts the sampling transistor T1 in a non-continuity state to electrically cut off the gate G of the drive transistor T2 from the signal line SL. Thus, the gate potential is interlocked with a variation in the potential at the drive transistor T2 to maintain the voltage Vgs between the gate G and the source S constant. Even when the current/voltage characteristic of the light emitting element EL is changed over time, the gate voltage Vgs can be maintained constant and no luminance change is caused.

Figure 3:
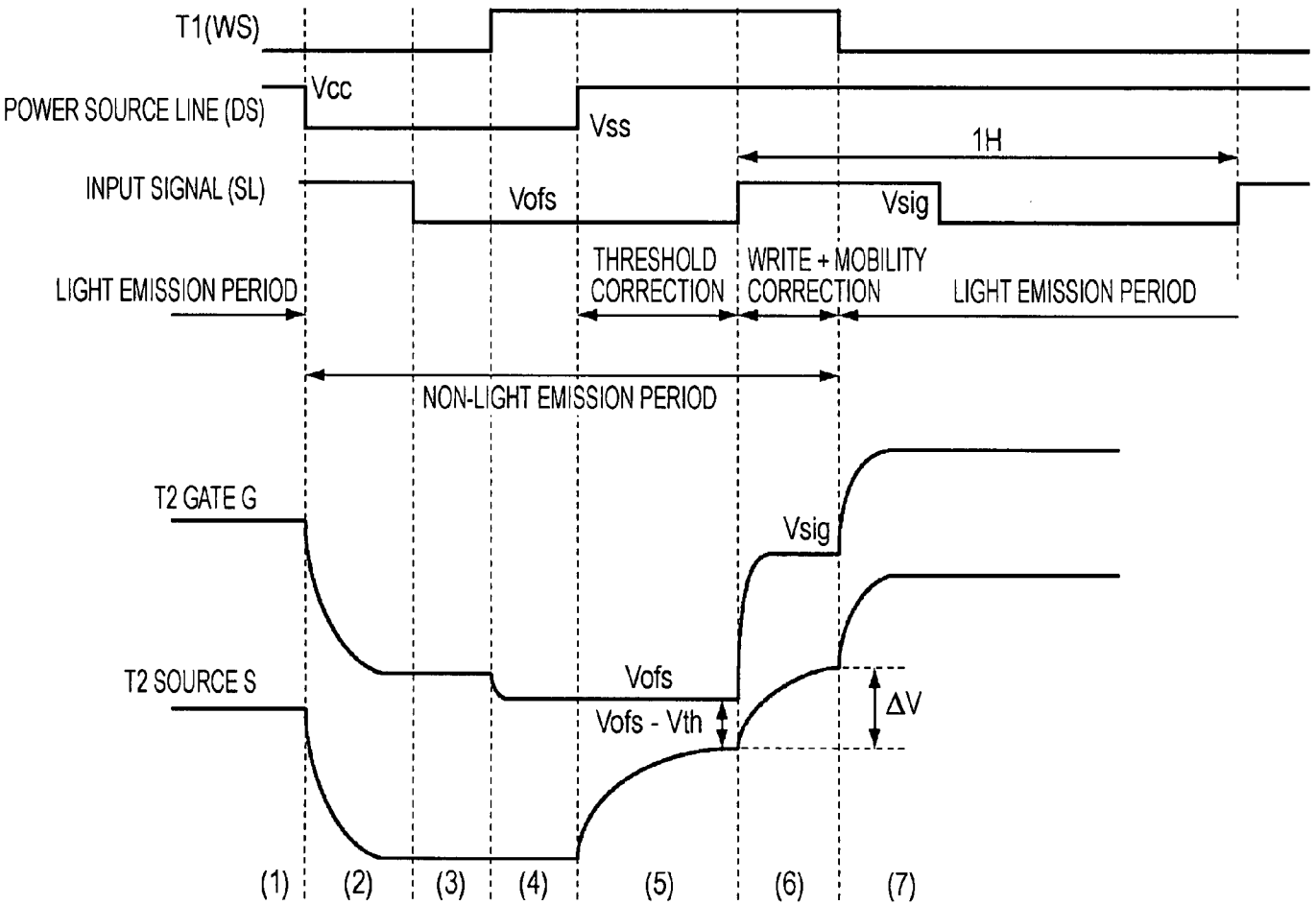
FIG. 3 is a timing chart used for explaining an operation of the pixel illustrated in FIG. 2.

FIG. 3 is a timing chart used for describing an operation of the pixel illustrated in FIG. 2. It should be noted that this timing chart is merely an example, and the control sequence of the pixel circuit illustrated in FIG. 2 is not limited to the timing chart of FIG. 3. This timing chart represents a potential change at the scanning lines WS, a potential change at the power feed lines DS, and a potential change at the signal line SL while a time axis is uniformly used. The potential change at the scanning lines WS represents the control signal, and an opening/closing control is performed on the sampling transistor T1. The potential change at the power feed lines DS represents a switching of power source voltages Vcc and Vss. Also, the potential change at the signal line SL represents a switching of the signal potential Vsig of the input signal and the reference potential Vofs. In addition, in parallel with these potential changes, potential changes at the gate G and the source S of the drive transistor T2 also are represented. As described above, a difference between the gate G and the potential at the source S corresponds to Vgs.

In this timing chart, for convenience, periods are divided into (1) to (7) in accordance with the transit of the pixel operation. During the period (1) immediately before entering the field, the light emitting element EL is in the light emission state. After that, during the initial period (2) after entering the new field of the line progressive scanning, the power feed lines DS is switched from the first potential Vcc to the second potential Vss. After proceeding to the next period (3), the input signal is switched from Vsig to Vofs. Furthermore, during the next period (4), the sampling transistor T1 is turned ON. During these periods (2) to (4), the gate voltage and the source voltage of the drive transistor T2 are initialized. The periods (2) to (4) are preparation periods for the threshold voltage correction. The gate G of the drive transistor T2 is initialized to Vofs, and on the other hand, the source S is initialized to Vss. Subsequently, during the threshold correction period (5), the threshold voltage correction operation is actually carried out, and the voltage equivalent to the threshold voltage Vth is held between the gate G and the source S of the drive transistor T2. In actuality, the voltage equivalent to Vth is written in the holding capacitance C1 connected between the gate G and the source S of the drive transistor T2. After that, the process is advanced to the write period/mobility correction period (6). Herein, the signal potential Vsig of the video signal is written in the holding capacitance while being added to Vth, and also a voltage ΔV for the mobility correction is subtracted from the voltage held in the holding capacitance C1. In the write period/mobility correction period (6), it is necessary to set the sampling transistor T1 in the continuity state in a time slot when the signal line SL is at the signal potential Vsig. After that, the process is advanced to the light emission period (7), and the light emitting element emits light at a luminance in accordance with the signal potential Vsig. At that time, as the signal potential Vsig is adjusted based on the voltage equivalent to the threshold voltage Vth and the voltage ΔV for the mobility correction, the light emission luminance of the light emitting element EL is not influenced by the dispersion of the threshold voltage Vth of the drive transistor T2 or the mobility μ. It should be noted that the bootstrap operation is carried out at the beginning of the light emission period (7), and while the voltage Vgs applied between the gate G and the source S of the drive transistor T2 is maintained constant, the gate potential and the source potential at the drive transistor T2 is increased.

Figure 4:
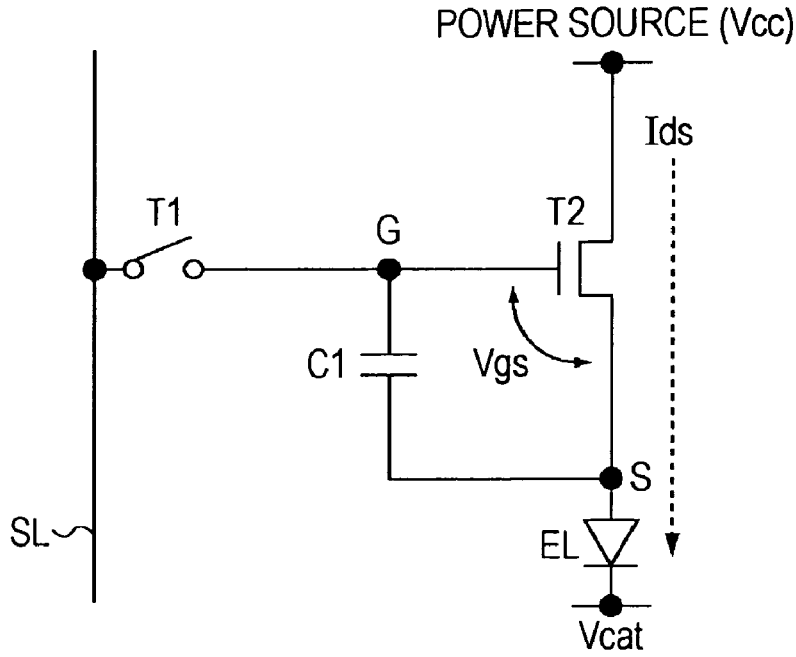
FIG. 4 is a schematic diagram used for explaining the operation of the pixel illustrated in FIG. 2.

Subsequently, with reference to FIGS. 4 to 11, the operation of the pixel circuit illustrated in FIG. 2 will be described in detail. First, as illustrated in FIG. 4, during the light emission period (1), the power source potential is set as Vcc and the sampling transistor T1 is turned OFF. At this time, as a setting is effected in which the drive transistor T2 is operated in the saturated area, the drive current Ids flowing through the light emitting element EL takes a value indicated by the above-mentioned transistor characteristic expression in accordance with the voltage Vgs applied between the gate G and the source S of the drive transistor T2.

Figure 5:
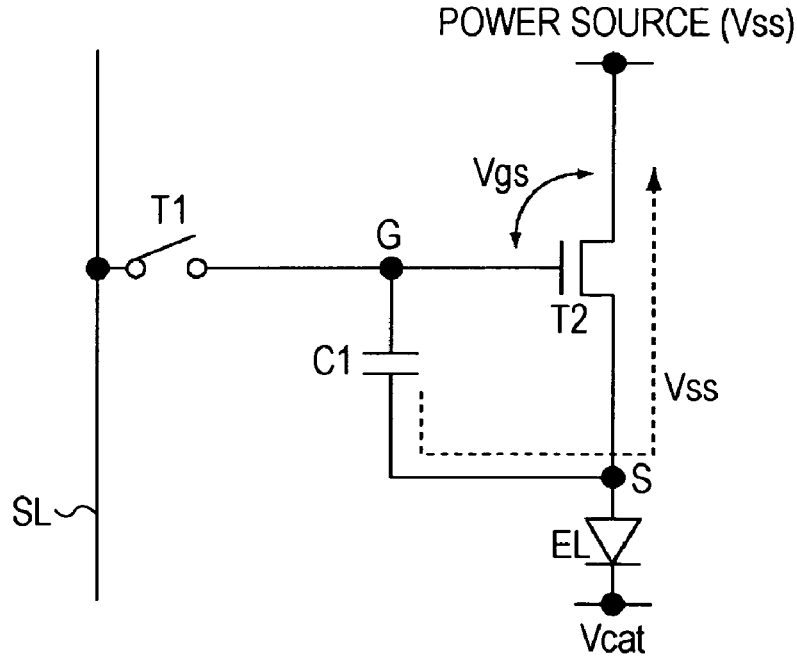
FIG. 5 is a schematic diagram used for explaining the operation of the pixel illustrated in FIG. 2.

Then, as illustrated in FIG. 5, when the process enters the preparation periods (2) and (3), the potential at the power feed line (the power source line) is set as Vss. At this time, Vss is set to be smaller than the sum of the threshold voltage Vthel of the light emitting element EL and the cathode voltage Vcat. That is, Vss<Vthel+Vcat is established. The light from the light emitting element EL is turned OFF and the power source line side becomes the source of the drive transistor T2. At this time, the anode of the light emitting element EL is charged to Vss.

Figure 6:
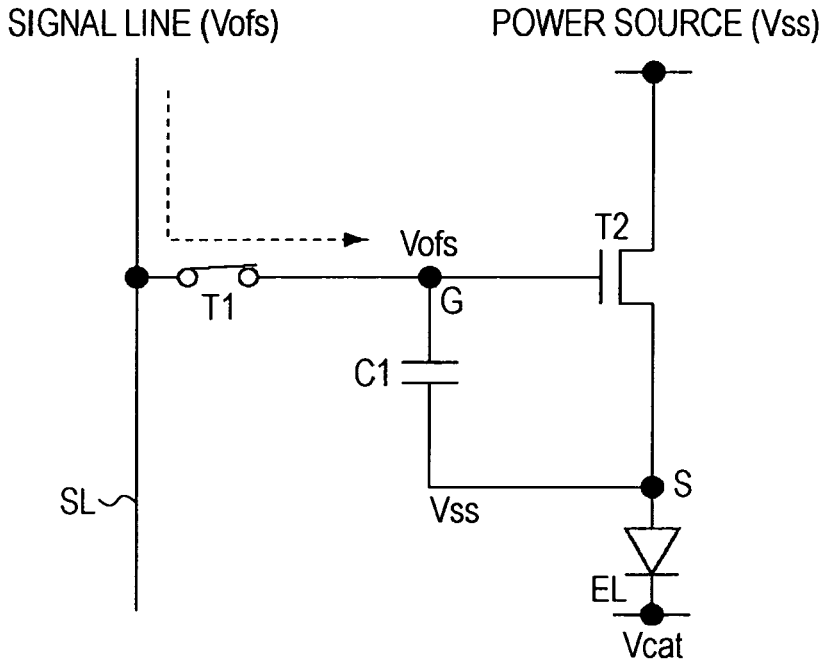
FIG. 6 is a schematic diagram used for explaining the operation of the pixel illustrated in FIG. 2.

Furthermore, as illustrated in FIG. 6, when the process enters the next preparation period (4), the potential at the signal line SL is turned into Vofs. On the other hand the sampling transistor T1 is turned ON, and the gate potential at the drive transistor T2 is set as Vofs. In this manner, the source S and the gate G of the drive transistor T2 are initialized during the light emission. The voltage Vgs applied between the gate and the source at this time takes a value obtained through Vofs−Vss. Vgs=Vofs−Vss is set to be larger than the threshold voltage Vth of the drive transistor T2. In this manner, the drive transistor T2 is initialized to establish Vgs>Vth, and the preparations for the next threshold voltage correction operation are completed.

Figure 7:
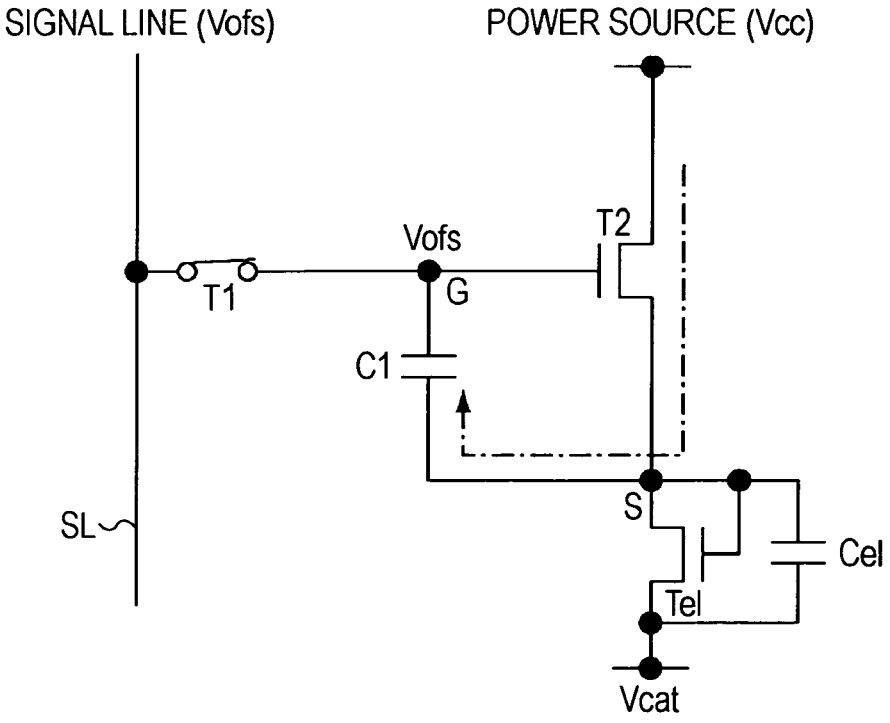
FIG. 7 is a schematic diagram used for explaining the operation of the pixel illustrated in FIG. 2.

Subsequently, as illustrated in FIG. 7, when the process is advanced to the threshold voltage correction period (5), the potential at the power feed lines DS (the power source line) is returned to Vcc. By setting the power source voltage as Vcc, the anode of the light emitting element EL becomes the source S of the drive transistor T2, and a current flows as illustrated in the drawing. At this time, an equivalent circuit of the light emitting element EL is represented as a parallel connection of a diode Tel and a capacitance Cel as illustrated in the drawing. The anode potential (that is, the source potential Vss) is lower than Vcat+Vthel. Thus, the diode Tel is in an OFF state, and a leak current flowing into the diode Tel is smaller than a current flowing into the drive transistor T2. Thus, almost all of the current flowing into the drive transistor T2 is used for charging the holding capacitance C1 and the equivalent capacitance Cel.

Figure 8:
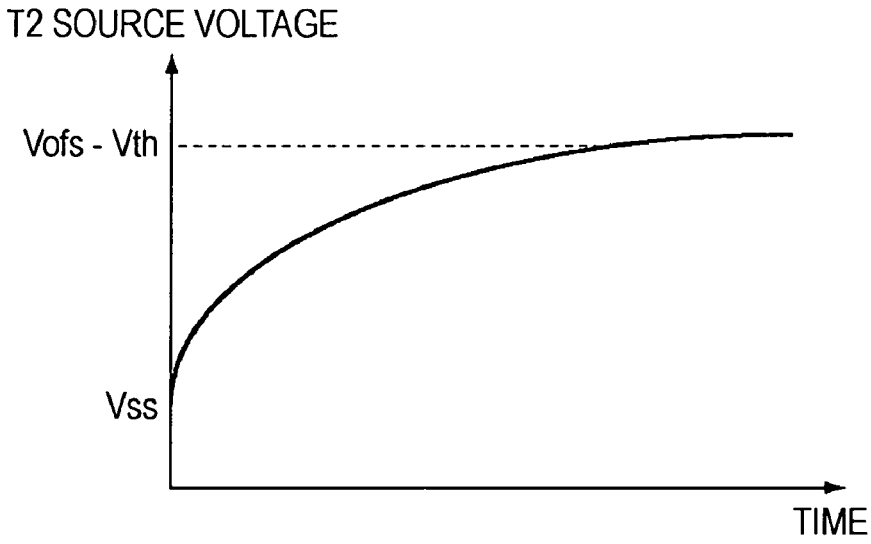
FIG. 8 is a graphic representation used for explaining the operation of the pixel illustrated in FIG. 2.

FIG. 8 illustrates a temporal change of the source of the drive transistor T2 voltage in the threshold voltage correction period (5) illustrated in FIG. 7. As illustrated in the drawing, the source of the drive transistor T2 voltage (that is, the anode of the light emitting element EL voltage) is increased from Vss over time. When the threshold voltage correction period (5) is elapsed, the drive transistor T2 is cut off, and the voltage Vgs between the source S and the gate G becomes Vth. At this time, the source potential is obtained through Vofs−Vth. If this value Vofs−Vth is still lower than Vcat+Vthel, the light emitting element EL is in an interrupted state.

Figure 9:
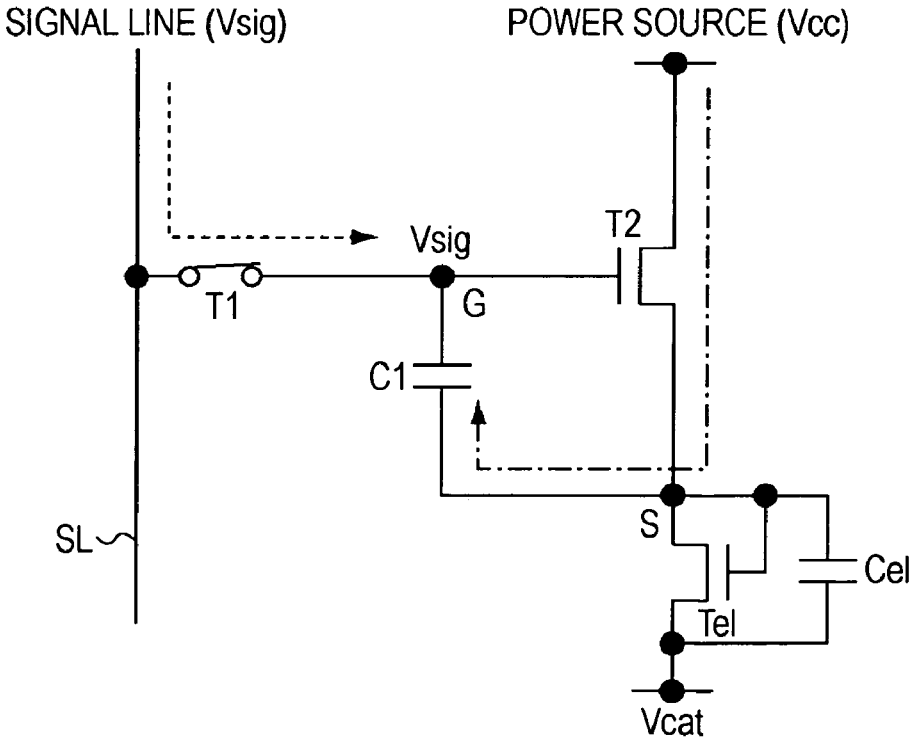
FIG. 9 is a schematic diagram used for explaining the operation of the pixel illustrated in FIG. 2.

Next, as illustrated in FIG. 9, when the process is advanced to the write period/mobility correction period (6), in a state where the sampling transistor T1 is subsequently turned ON, the potential at the signal line SL is switched from Vofs to Vsig. At this time, the signal potential Vsig corresponds to a voltage in accordance with a gradation. The gate potential at the drive transistor T2 becomes Vsig as the sampling transistor T1 is turned ON. On the other hand, the source potential is increased over time as the current flows from the power source Vcc. Even at this point, if the potential at the drive transistor T2 does not exceed the sum of the threshold voltage Vthel of the light emitting element EL and the cathode voltage Vcat, the current flowing from the drive transistor T2 is mainly used for charging the equivalent capacitance Cel and the holding capacitance C1. At this time, the threshold voltage correction operation of the drive transistor T2 is already completed, and thus the current flowing through the drive transistor T2 reflects the mobility μ. To be more specific, in the drive transistor T2 with the large mobility μ, the current amount at this time is large and the source potential increased amount ΔV is also large. In contrast, in a case where the mobility μ is small, the current amount of the drive transistor T2 is small and the source increased amount ΔV becomes small. Through such an operation, the gate voltage Vgs of the drive transistor T2 reflects the mobility μ and is compressed by ΔV. When the mobility correction period (6) is completed, it is possible to obtain Vgs in which the mobility μ is properly corrected.

Figure 10:
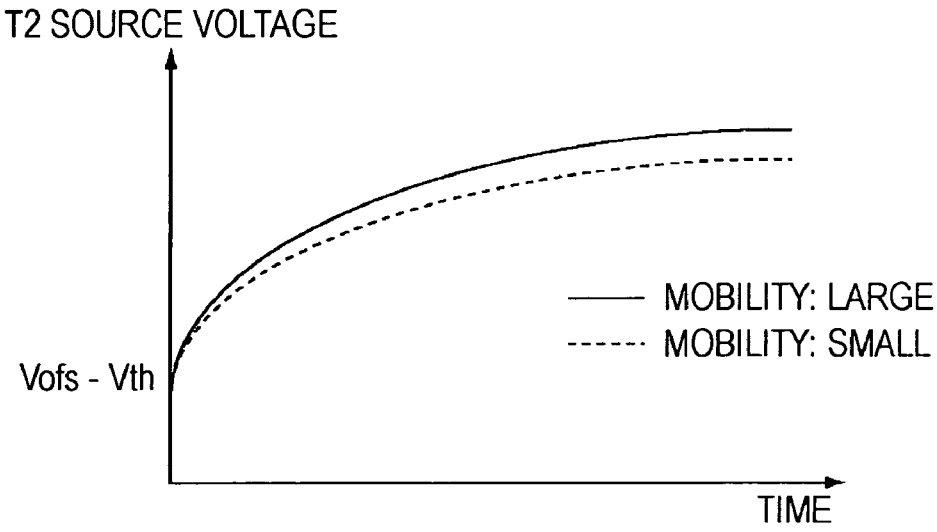
FIG. 10 is a graphic representation used for explaining the operation of the pixel illustrated in FIG. 2.

FIG. 10 is a graphic representation of a temporal change of the source of the drive transistor T2 voltage in the above-mentioned mobility correction period (6). As illustrated in the drawing, when the mobility of the drive transistor T2 is large, the source voltage is quickly increased, and Vgs is accordingly compressed. That is, when the mobility μ is large, Vgs is compressed so as to cancel the influence, and the drive current can be suppressed. On the other hand, when the mobility μ is small, the source of the drive transistor T2 voltage is not so quickly increased, and thus Vgs is not subjected to a strong compression. Therefore, when the mobility μ is small, Vgs of the drive transistor is not subjected to a large compression so as to cover the small drive ability.

Figure 11:
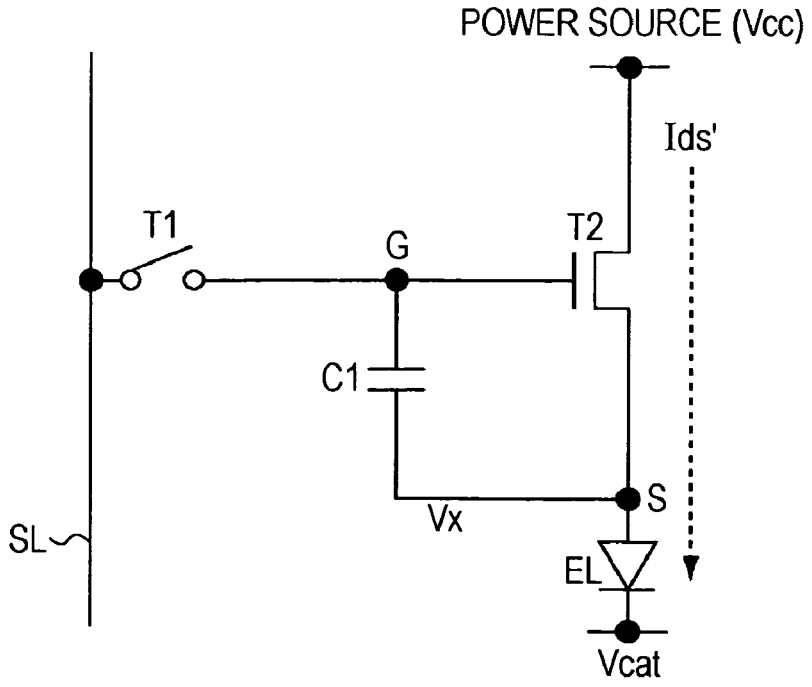
FIG. 11 is a schematic diagram used for explaining the operation of the pixel illustrated in FIG. 2.

FIG. 11 represents an operation state during the light emission period (7). During the light emission period (7), the sampling transistor T1 is turned OFF and the light emitting element EL emits light. The gate voltage Vgs of the drive transistor T2 is kept constant. The drive transistor T2 allows a constant current Ids' to flow into the light emitting element EL while following the above-mentioned characteristic expression. the anode of the light emitting element EL voltage (that is, the source of the drive transistor T2 voltage) is increased to Vx as the current Ids' flows into the light emitting element EL, and when Vcat+Vthel is exceeded, the light emitting element EL emits light. When the light emission time becomes long, the current/voltage characteristic of the light emitting element EL is changed. For that reason, the potential at the source S illustrated in FIG. 11 is changed. However, the gate voltage Vgs of the drive transistor T2 is kept at a constant value through the bootstrap operation, and thus the current Ids' flowing into the light emitting element EL is not changed. Thus, even when the current/voltage characteristic of the light emitting element EL is degraded, the constant drive current Ids' flows regularly, and the luminance of the light emitting element EL is not changed.

Figure 12A:
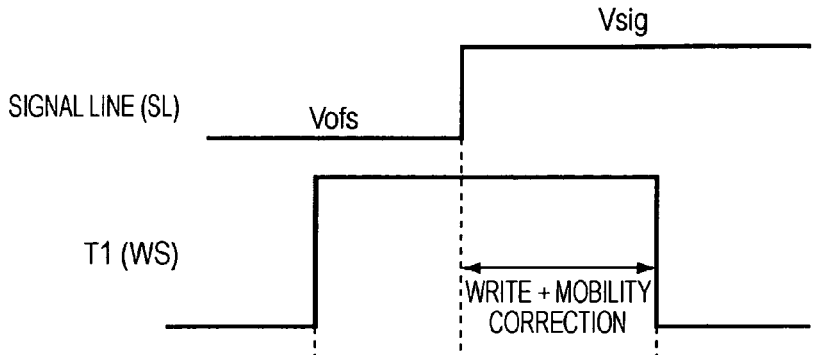
FIGS. 12A and 12B are timing charts used for explaining the operation of the pixel illustrated in FIG. 2.
Figure 12B:
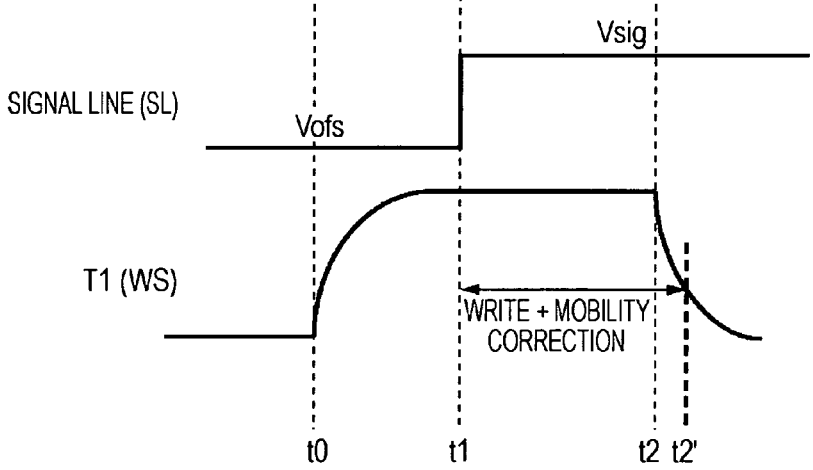

FIGS. 12A and 12B are schematic drawings of an operation of the signal write period/mobility correction period. FIG. 12A represents a control signal waveform applied to the pixel located on a side close to the control scanner. In other words, the control signal waveform is a waveform observed on the control signal input side of the scanning lines WS arranged so as to extend horizontally. On the other hand, FIG. 12B represents a control signal waveform observed on the side opposite to the input side.

First, as illustrated in FIG. 12A, on the input side, at the timing t0, after the control signal has risen and the sampling transistor T1 is turned ON, a period from the timing t1 when the signal line SL is switched from Vofs to Vsig to the timing t2 when the control signal WS has fallen and the sampling transistor T1 is turned OFF (t1–t2) becomes the write period/mobility correction period (6). On the input side, the control signal is not degraded and the write period/mobility correction period (6) keeps the time in accordance with the design specification.

In contrast, on the side opposite to the input illustrated in FIG. 12B, the control signal supplied to the scanning lines WS is slackened due to the influence of the wiring resistance or the wiring capacitance, and the rising waveform and the falling waveform are slackened. When the waveforms are slackened in this manner, an initial stage t1 of the writing period/the mobility period is not influenced, but an influence appears in a final stage, and a deviation is generated. According to the illustrated example, with respect to the timing t2 on the input side, the timing t2' on the side opposite to the input is shifted backward. In this manner, when the write period/mobility correction period is deviated along the scanning lines WS, the effect of the correction on the mobility μ becomes different. As a result, Vgs has a fluctuation, which appears as an unevenness of the light emission luminance. To be more specific, as the write time is longer on the side of the panel opposite to the control signal input, the fluctuation appears as shading on the screen. In particular, when the signal potential Vsig is at the maximum level (that is, at the time of white display), the increased amount ΔV of the source potential of the drive transistor in the mobility correction period becomes large. That is, as Vsig is higher, the current flowing into the drive transistor becomes larger, and a large negative feedback ΔV is applied on the holding capacitance. Accordingly, the source potential is largely increased. For this reason, in particular, the fluctuation of the write time in the white display appears notably, and image quality unevenness, such as shading, is generated.

Figures 13A, 13B, 13C:
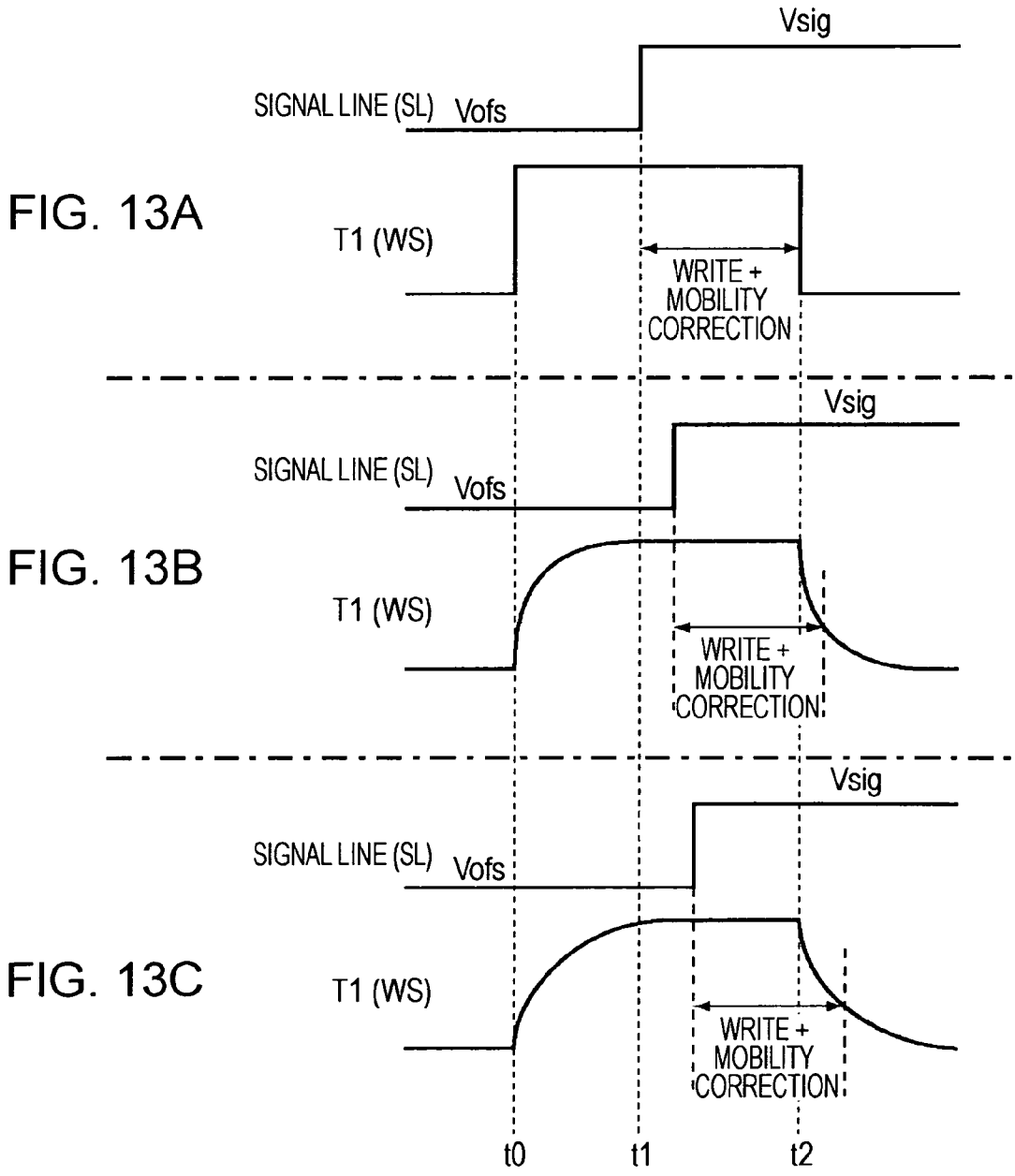
FIGS. 13A to 13C are timing charts used for explaining the operation of the pixel illustrated in FIG. 2.

FIGS. 13A to 13C are schematic diagrams for describing a principle of the embodiment of the present invention. These schematic diagrams represent the potential change of the video signal appearing on the signal line SL and the potential change of the control signal appearing on the scanning lines WS while the time axis is used uniformly. FIG. 13A illustrates a waveform observed on the input side of the control signal; FIG. 13C illustrates a waveform observed on the opposite side to the input side; and FIG. 13B illustrates a waveform observed at a center position between the two sides.

First, when the input side illustrated in FIG. 13A is focused, the control signal on the scanning lines WS rose at the first timing t0, and the sampling transistor T1 is turned ON. After that, at the second timing t1, the video signal on the signal line SL has risen from the reference potential Vofs to the signal potential Vsig. After that, at the third timing t2, the control signal on the scanning lines WS has fallen, and the sampling transistor T1 is turned OFF. A period between the second timing t1 and the third timing t2 becomes the write period/mobility correction period.

As illustrated in FIG. 13B, at a position substantially center of the scanning lines WS, in the control signal, due to the load of the wiring resistance or the wiring capacitance of the scanning lines WS, the rising waveform and the falling waveform of the control signal are slackened. In particular, as the rising waveform is slackened, the third timing t2 when the sampling transistor T1 is turned OFF is shifted backward. In order to cancel the backward shift amount, the second timing t1 when the video signal on the signal line SL is switched from the reference potential Vofs to Vsig is shifted backward. As a result, the write period/mobility correction period between the second timing t1 and the third timing t2 is equal to the input side illustrated in FIG. 13A, and no error of the mobility correction is generated.

As illustrated in FIG. 13C, on the side opposite to the input, due to the load of the scanning lines WS, the control signal waveform is further slackened, and the third timing t2 when the sampling transistor T1 is turned OFF is further shifted backward. In order to cancel the backward shift amount, on the signal driver side, the switching timing t1 of the video signal supplied to the signal line SL is shifted backward. As a result, the third timing t2 and the second timing t1 are both shifted backward, but the period between the timings (that is, the write period/mobility correction period) is constant, which is not different from the state illustrated in FIGS. 13A an 13B. In this manner, as the slack amount of the failing of the control signal is larger, the switching phase of the video signal is shifted more backwardly. According to such a method, even when the load of the scanning lines WS (gate line) is large, the write operation and the mobility correction operation can be performed normally, and it is possible to reduce or remove the shading to obtain an uniform image quality.

Figure 14:
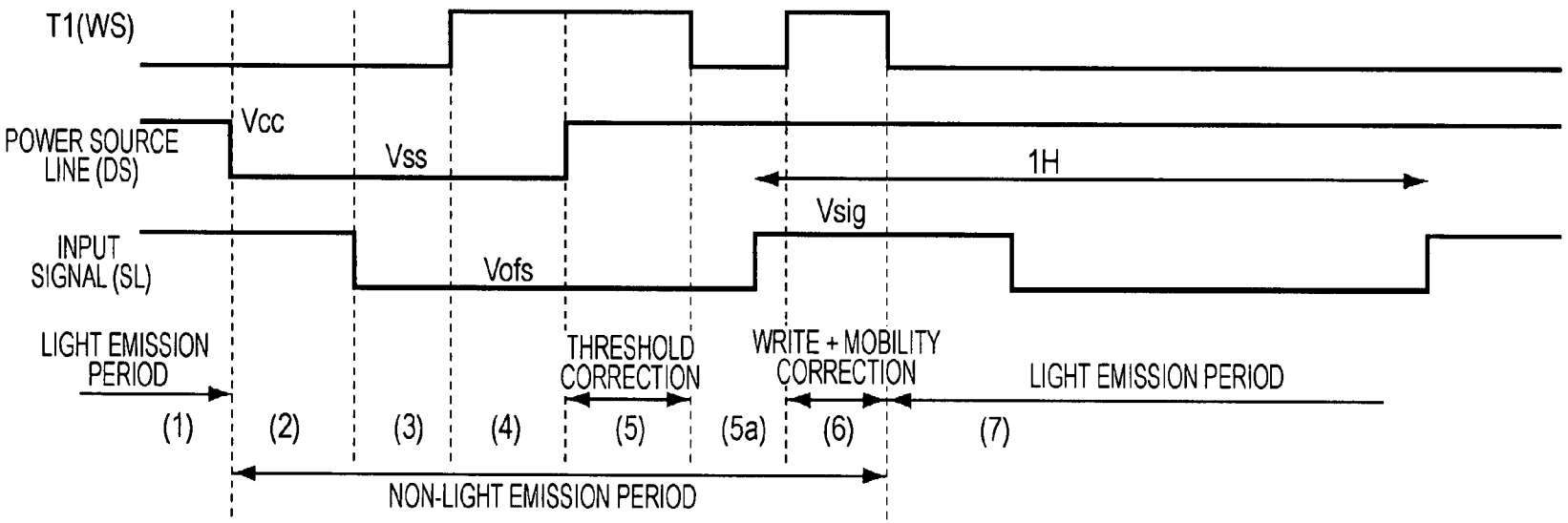
FIG. 14 is a timing chart used for explaining an operation of a display apparatus according to a reference example.

FIG. 14 illustrates a reference example of the operation sequence of the pixel illustrated in FIG. 2. For facilitating an understanding, a similar representation to the timing chart illustrated in FIG. 3 is adopted. The basic control sequence is similar to the case illustrated in FIG. 3, but a difference resides in the control timing for the write period/mobility correction period. According to the present reference example, after the threshold voltage correction period (5), and during the preparation period (5*a*), one terminal of the scanning lines WS is set as the low level and the sampling transistor T1 is turned OFF. After that, the process is advanced to the write period/mobility correction period (6), during a time slot when the input signal is at Vsig, the scanning lines WS is set as the high level again and the sampling transistor T1 is turned ON. That is, according to the present reference example, the write scanner 4 puts the sampling transistor T1 in the continuity state during the time slot when the signal line SL is at the signal potential Vsig. Thus, the control signal in a pulse form which has a time width shorter than this time slot is output to the scanning lines WS and applied to the gate of the sampling transistor T1 to establish the continuity state.

Figure 15A:
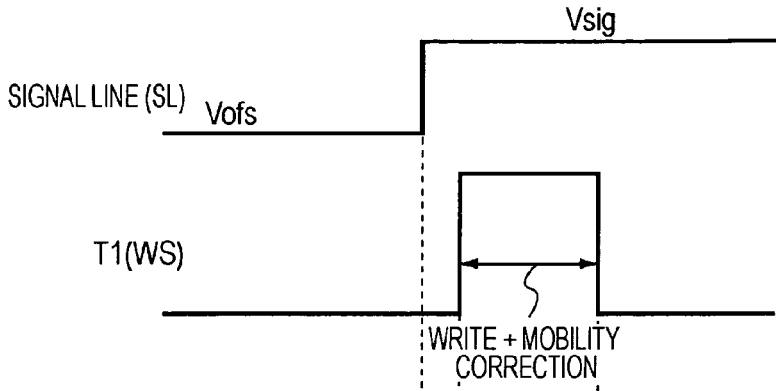
FIGS. 15A to 15C are timing charts used for explaining the operation of the display apparatus according to the reference example.
Figure 15B:
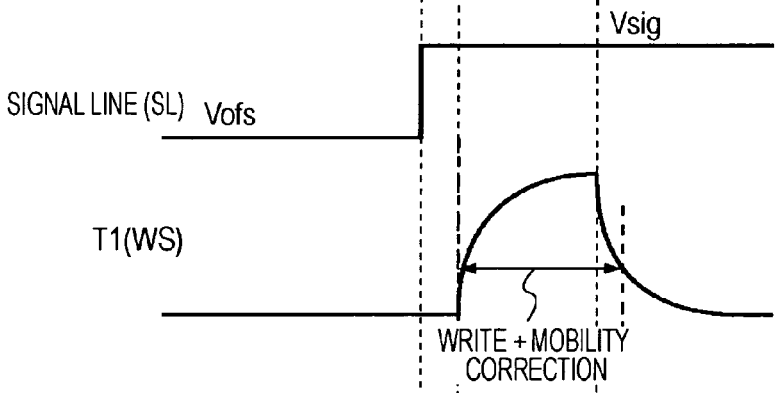
Figure 15C:
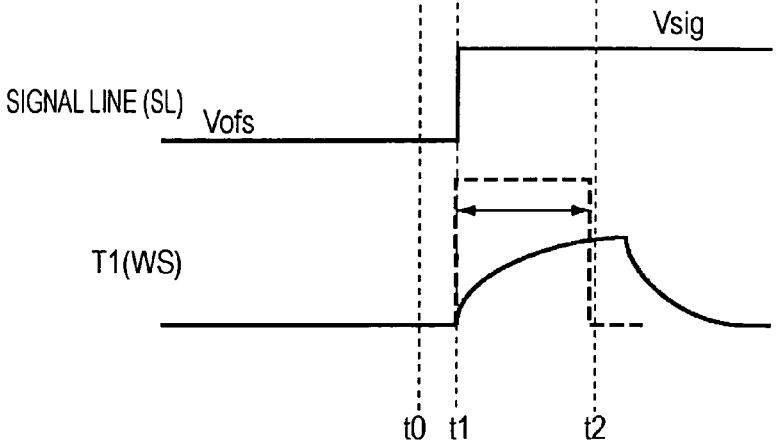

FIGS. 15A to 15C are schematic diagrams in which the write period/mobility correction period (6) is particularly extracted from the operation sequence illustrated in FIG. 14. FIG. 15A illustrates a signal state on the input side; and FIG. 15C illustrates a signal state on the opposite side to the input. FIG. 15B illustrates a signal state at a center position between the input side and the opposite side. As illustrated in FIG. 15A, after the signal line SL is changed at the timing t0 from Vofs to Vsig, the pulsed control signal is applied to the scanning lines WS to turn the sampling transistor T1 ON. Therefore, the write period/mobility correction period (6) according to the reference example is determined as a period from t1 when the control signal has risen to t2 when the control signal has dropped. On the input side, the control signal pulse is hardly degraded and has a rectangular wave. Thus, it is possible to obtain the write period/mobility correction period as designed.

On the other hand, as illustrated in FIG. 15B, at the center position between the input side and the opposite side, the rising and falling of the control signal pulse are slanted due to the transfer delay. According to the illustrated example, in response to the control signal, the voltage level at which the sampling transistor T1 is turned ON is represented as a line segment attached with a double-headed arrow. In this manner, when an ON level is relatively low, as compared with the ON timing t1, the OFF timing t2 is shifted backward relatively. Therefore, the write period/mobility correction period becomes long. On the other hand, when the voltage level at which the sampling transistor T1 is turned ON is high, the ON timing t1 is shifted backward largely, but the OFF timing t2 is not so much shifted backward. Therefore, the write period/mobility correction period becomes short as compared with the standard of FIG. 15A. In this manner, according to the method of regulating the write period/mobility correction period only on the basis of the pulse width of the control signal, the write period/mobility correction period is largely influenced by the waveform degradation of the control signal pulse.

FIG. 15C illustrates a control signal waveform observed on the side opposite to the input. Due to the load of the scanning lines WS, the control signal pulse is significantly degraded, and no longer the voltage level at which the sampling transistor T1 is turned ON is not reached. In such a case, the signal potential of the video signal cannot be sampled and an operation failure is caused. As described above, the writing period is a period of writing the signal potential Vsig of the video signal in the holding capacitance C1 and at the same time a time for negatively feeding back the current flowing through the drive transistor T2 to the holding capacitance C1. If this writing time takes too long, Vgs is decreased due to the negative feedback and the light emission luminance cannot be obtained. For that reason, the pulse width of the control signal needs to be short, and in the worst case, as illustrated in FIG. 15C, the sampling transistor T1 may not be turned on due to a substantial waveform degradation.

Figure 16:
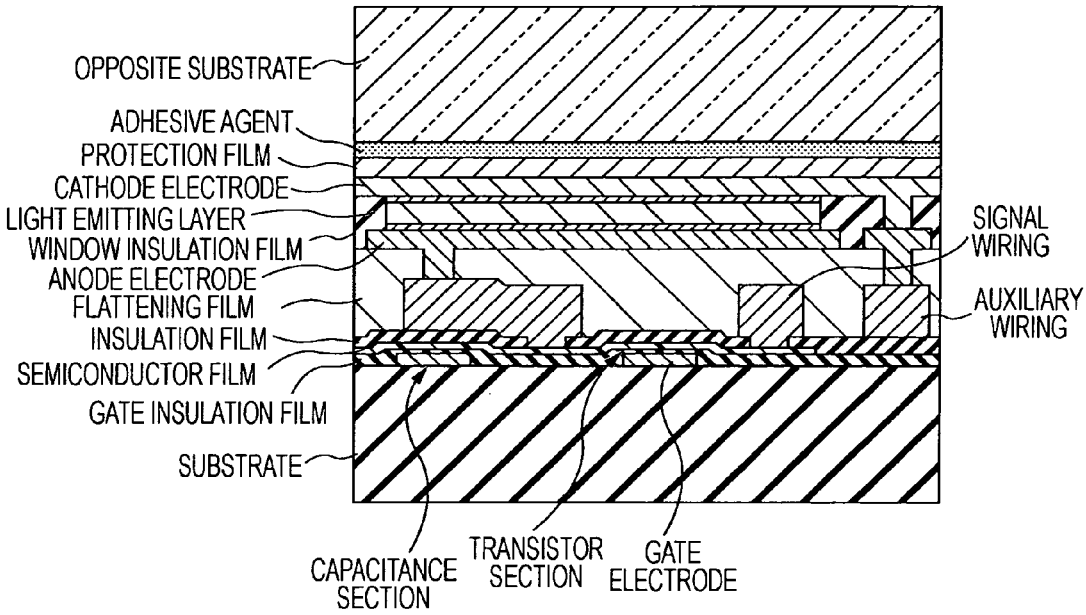
FIG. 16 is a cross sectional view of a device configuration of the display apparatus according to an embodiment of the present invention.

The display apparatus according to the embodiment of the present invention has a thin film device configuration as illustrated in FIG. 16. FIG. 16 illustrates a schematic cross sectional configuration of a pixel formed on an insulating substrate. As illustrated in the drawing, the pixel includes a transistor section including a plurality of thin film transistors (one TFT is exemplified in the drawing), a capacitance section such as the holding capacitance, and a light emitting section such as an organic EL element. A transistor section and a capacitance section are formed on a substrate through a TFT process, and on top of these, the light emitting section such as the organic EL element are is laminated. On top, a transparent opposite substrate is affixed via an adhesive agent to manufacture a flat panel screen.

Figure 17:
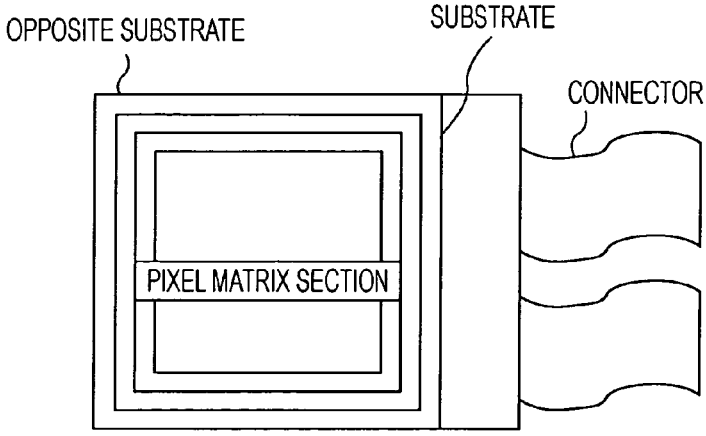
FIG. 17 is a plan view of a module configuration of the display apparatus according to an embodiment of the present invention.

The display apparatus according to the embodiment of the present invention includes, as illustrated in FIG. 17, a flat display apparatus having a module shape. For example, a pixel array section in which pixels composed of an organic EL element, a thin film transistor, a thin film capacitance, and the like are integrally formed in a matrix is formed on an insulating substrate. An adhesive agent is arranged so as to affix this pixel array section (pixel matrix section) and an opposite substrate made of glass or the like to form a display module. When necessary, a color filter, a protection film, a light blocking film, and the like may be provided to this opposite substrate. A FPC (flexible print circuit) may be provided to the display module as a connector for inputting and outputting the signals from the outside to the pixel array section, for example.

The display apparatus according to the embodiment of the present invention described above has a flat panel shape and can be applied to various electronic devices, for example, a digital camera, a laptop personal computer, a mobile telephone, a video camera, etc., and displays of an electronic device in any field for displaying the video signal are input to the electronic device or generated in the electronic device as an image or a video.

Hereinafter, examples of the electronic devices to which such a display apparatus is applied will be illustrated.

Figure 18:
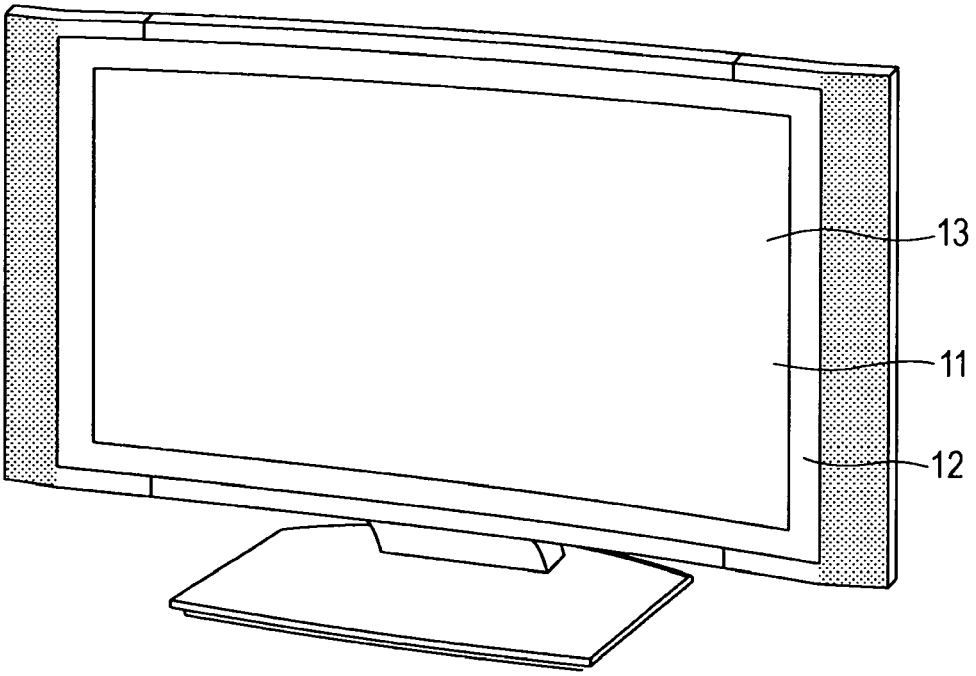
FIG. 18 is a perspective view of a television set provided with the display apparatus according to an embodiment of the present invention.

FIG. 18 illustrates a television to which an embodiment of the present invention is applied. The television includes a video display screen 11 composed of a front panel 12, a filter glass 13, and the like, and is manufactured by using the display apparatus according to the embodiment of the present invention for the video display screen 11.

Figure 19A:
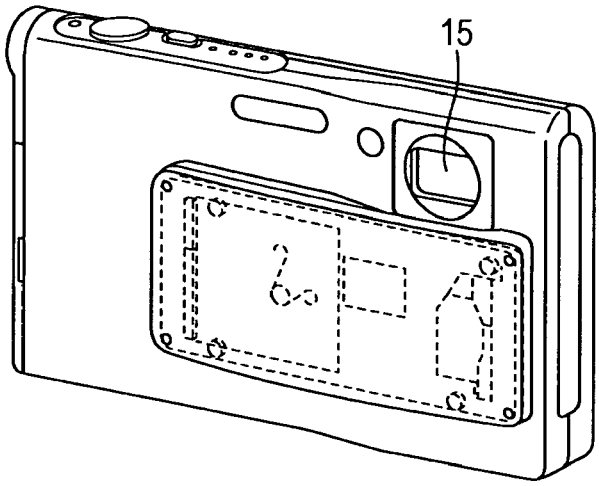
FIGS. 19A and 19B are perspective views of a digital still camera provided with the display apparatus according to an embodiment of the present invention.
Figure 19B:
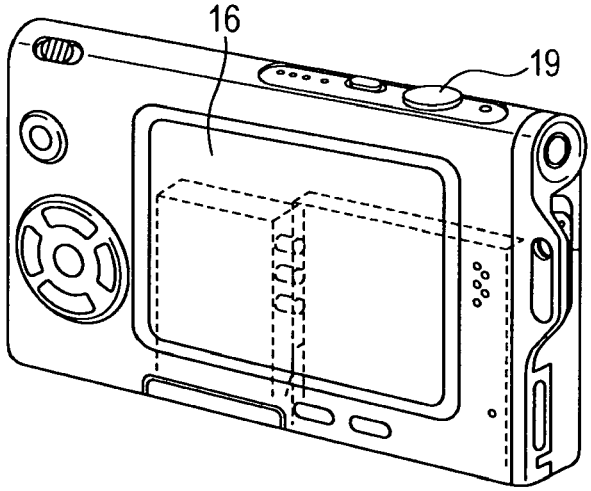

FIGS. 19A and 19B illustrate a digital camera to which an embodiment of the present invention is applied. FIG. 19A is a front view and FIG. 19B is a rear view of the digital camera. This digital camera includes an image pickup lens, a flash light emitting section 15, a display section 16, a control switch, a menu switch, a shutter 19, and the like, and is manufactured by using the display apparatus according to the embodiment of the present invention for the display section 16.

Figure 20:
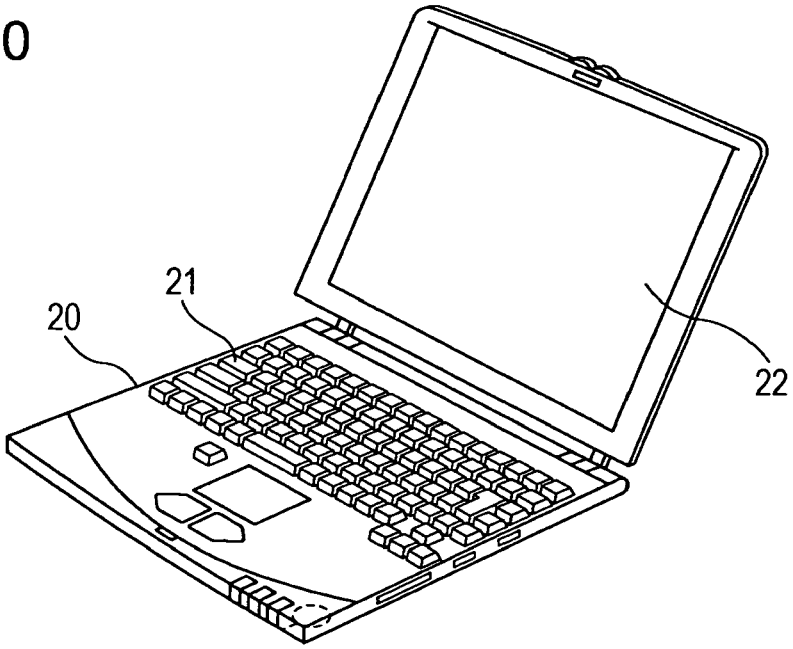
FIG. 20 is a perspective view of a laptop personal computer provided with the display apparatus according to an embodiment of the present invention.

FIG. 20 illustrates a laptop personal computer to which an embodiment of the present invention is applied. A main body 20 of the laptop personal computer includes a key board 21, which is operated when a character or the like is input, and a main body cover of the laptop personal computer includes a display section 22 for displaying an image. The laptop personal computer is manufactured by using the display apparatus according to the embodiment of the present invention for the display section 22.

Figure 21A:
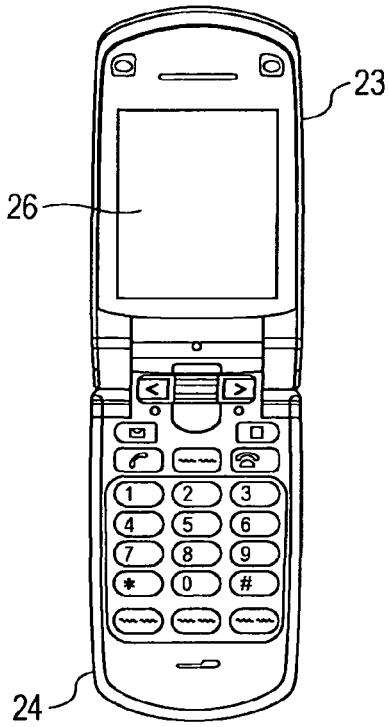
FIGS. 21A and 21B are schematic diagrams of a mobile terminal apparatus provided with the display apparatus according to an embodiment of the present invention.
Figure 21B:
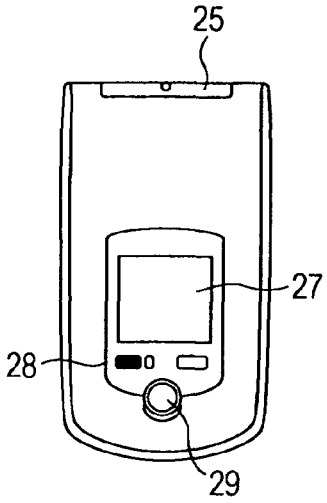

FIGS. 21A and 21B illustrate a mobile telephone apparatus to which an embodiment of the present invention is applied. FIG. 21A illustrates an opened state and FIG. 21B illustrates a closed state of the mobile telephone apparatus. This mobile telephone apparatus includes an upper casing 23, a lower casing 24, a coupling section (herein, a hinge section) 25, a display 26, a subdisplay 27, a picture light 28, a camera 29, and the like, and is manufactured by using the display apparatus according to the embodiment of the present invention for the display 26 and the subdisplay 27.

Figure 22:
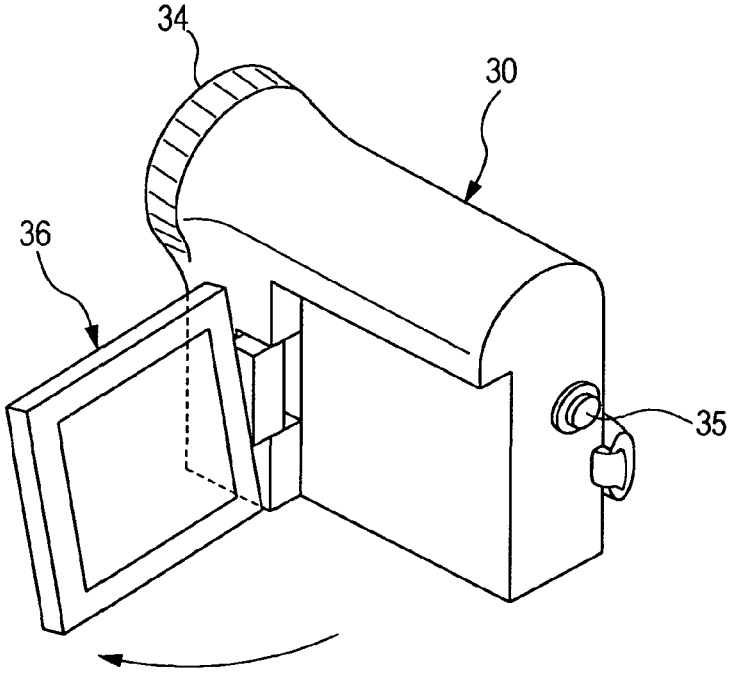
FIG. 22 is a perspective view of a video camera provided with the display apparatus according to an embodiment of the present invention.
Figure 23:
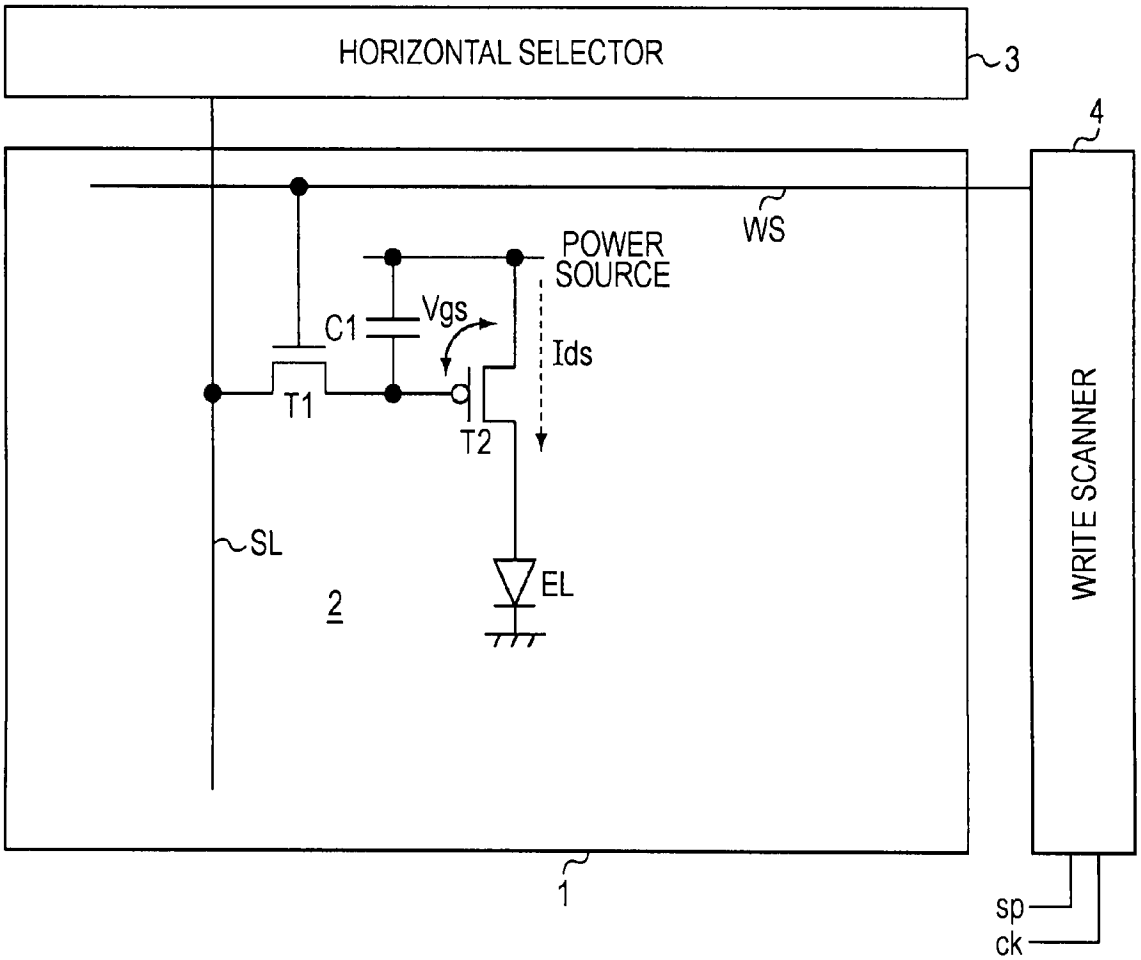
FIG. 23 RELATED ART
FIG. 23 is a circuit diagram of an example of a display apparatus in related art.
Figure 24:
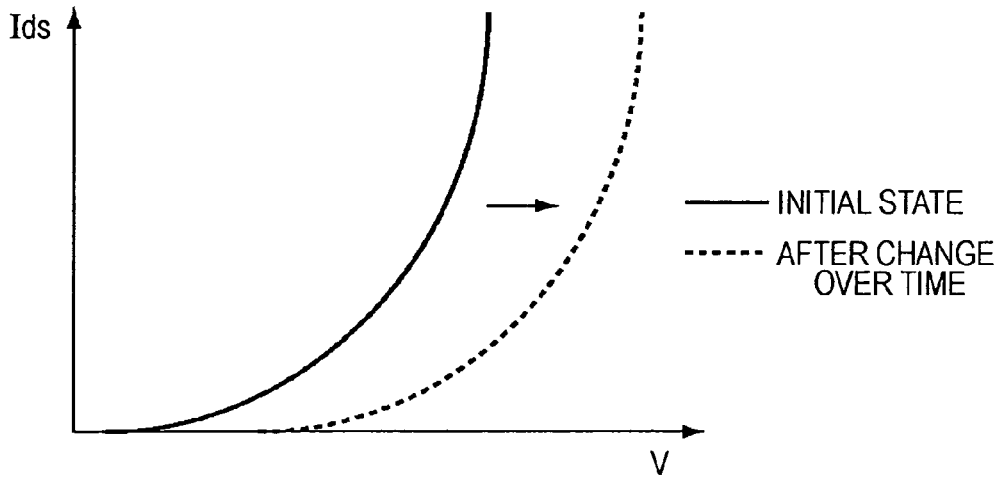
FIG. 24 RELATED ART
FIG. 24 is a graphic representation of a problem of the display apparatus in related art.
Figure 25:
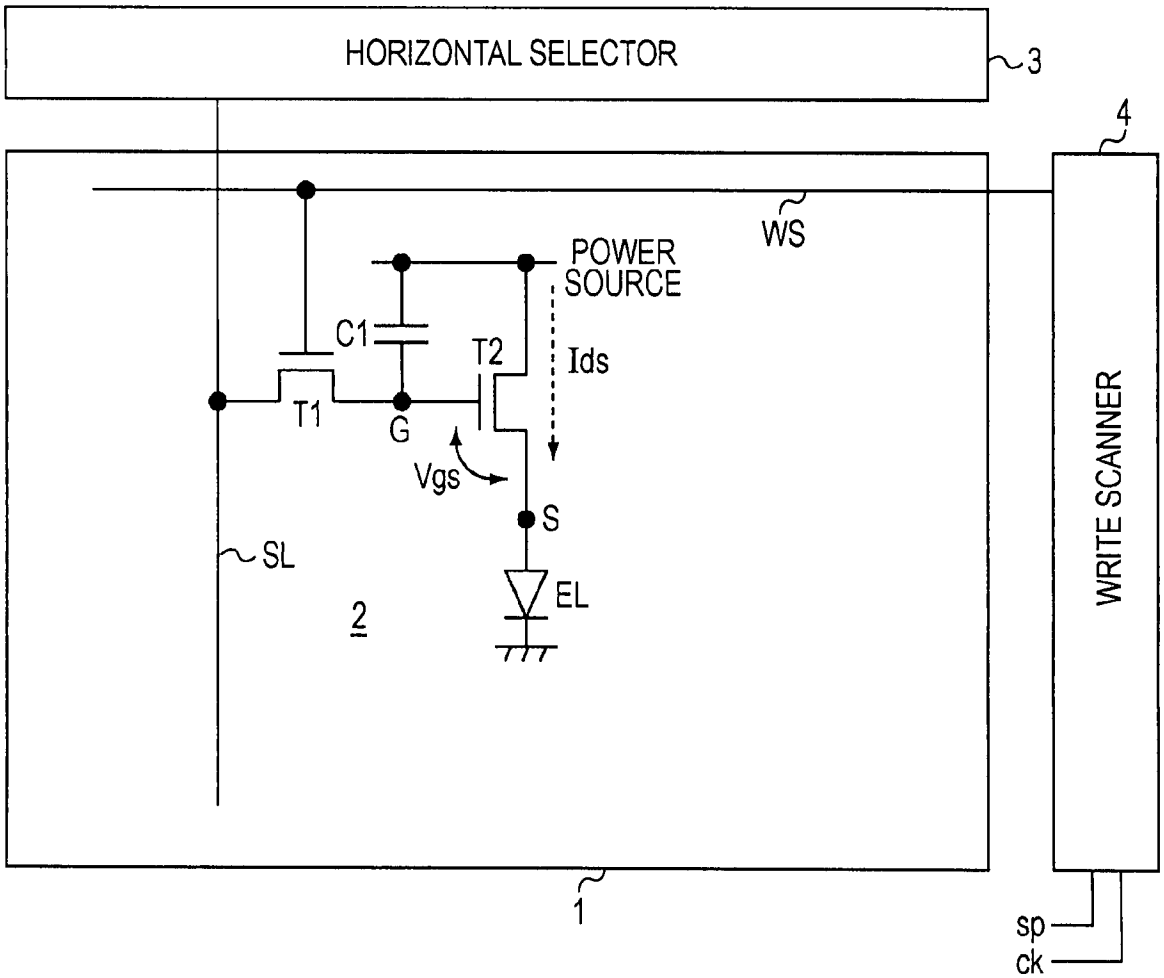
FIG. 25 RELATED ART
FIG. 25 is a circuit diagram of another example of the display apparatus in related art.

FIG. 22 illustrates a video camera to which an embodiment of the present invention is applied. The video camera includes a main body section 30, a lens 34 for subject image pickup arranged on a side when facing forward, a start/stop switch 35 at the time of the image pickup, a monitor 36, and the like, and is manufactured by using the display apparatus according to the embodiment of the present invention for the monitor 36.

It should be understood by those skilled in the art that various modifications, combinations, subcombinations and alterations may occur depending on design requirements and other factors insofar as they are within the scope of the appended claims or the equivalents thereof.

What is claimed is:

1. A display apparatus comprising:

a pixel array section and a drive section for driving the pixel array section, the pixel array section including scanning lines arranged in rows, signal lines arranged in columns, and pixels arranged in a matrix, the drive section including a control scanner adapted to sequentially output control signals to the respective scanning line and carrying out line progressive scanning on the pixels in units of a row, and a signal driver adapted to supply the signal lines with a video signal in accordance with the line progressive scanning, the signal driver adjusting a timing when the video signal has changed from a reference potential to a signal potential for the video signal supplied to the respective signal lines to correct a backward shift due to a transmission delay along the scanning line of a control signal output from the control scanner and to maintain a total period of a writing period and a mobility correction period constant.

2. A method of driving signals lines in a display apparatus comprising a pixel array section and a drive section for driving the pixel array section, the pixel array section including scanning lines arranged in rows, signal lines arranged in columns, and pixels arranged in a matrix, the drive section including a control scanner adapted to sequentially output control signals to the respective scanning line and carrying out line progressive scanning on the pixels in units of a row, the method comprising:

supplying the signal lines with a video signal in accordance with the line progressive scanning, and adjusting a timing when the video signal has changed from a reference potential to a signal potential for the video signal supplied to the respective signal lines to correct a backward shift due to a transmission delay along the scanning line of a control signal output from the control scanner and to maintain a total period a writing period and a mobility correction period constant.

3. An electronic device comprising the display apparatus according to claim 1.

* * * * *